United States Patent [19]

Lapp

[11] 4,422,255

[45] Dec. 27, 1983

[54] MATCHLOCK CONVERTOR

[76] Inventor: Michael L. Lapp, Box 221, Jerome, Pa. 15937

[21] Appl. No.: 363,060

[22] Filed: Mar. 29, 1982

[51] Int. Cl.[3] ..... F41C 11/02

[52] U.S. Cl. ..... 42/69 R; 42/51

[58] Field of Search ..... 42/51, 69 R

[56] References Cited

U.S. PATENT DOCUMENTS 3,744,169 7/1973 Straight ..... 42/51

*Primary Examiner*—Charles T. Jordan

*Assistant Examiner*—Ted L. Parr

[57] ABSTRACT

The action of a flintlock mechanism used for firing rifles, pistols, and similar devices, whereby a flint or flintstone is normally used for igniting of the flashpan powder, is benefitted by the conversion of the flintlock mechanism to a matchlock mechanism by the incorporation of a matchlock convertor with use of a phosphorus match or matches for the purpose of igniting the flashpan powder.

1 Claim, 6 Drawing Figures

MATCHLOCK CONVERTOR

BACKGROUND OF THE INVENTION

1. Field of the Invention

This invention relates to the construction of a convertor and use thereof, within a flintlock mechanism utilizing features of both the matchlock and flintlock mechanisms.

2. Description of the Prior Art

The desirability of providing an instantaneous, reliable, and safer primary ignition system for flintlock firearms has long been recognized. The older mechanism of the matchlock was introduced about the year 1620, consisting of gunpowder or flashpowder placed on the exposed surface opening of the priming hole. The disadvantage and unsafe procedure was the necessity of holding by hand a long rod or taper with hot coals or embers affixed to the tip of the rod, then touching the flashpowder to cause the ignition. Later, a refined development was an arm on the mechanism and similar to the rod had smoldering bits of wool and cotton wastes as igniting agents. The arm upon triggered release, ignited the flashpowder, subsequently igniting through the priming hole and to the main powder charge firing the weapon. The addition of a trigger and touch-arm helped the matchlock system greatly, but the problem persisted of igniting materials burning away before use, giving rise to the development of the flintlock.

A flintlock mechanism differs slightly from the matchlock system only in the sense that a flintstone or flint is used instead of the burning or soldering materials. The matchlock touch-arm becoming a cock or striker-hammer on the flintlock mechanism, the cock with a set of jaws that the flintstone fits therein. Trigger pressure releases the cock with inset flint to strike an upstanding frizzen sending a shower of sparks into the flashpowder in the flashpan with resulting ignitions simulating the matchlock. Some of the disadvantages of the flintlock system being a great number of misfires as the flint chips and wears away, fails to spark, with resulting wear to the tempered face of the frizzen.

This invention acts in relation to, but overcomes the disadvantages of the prior art by providing a substantial increase and regulated amount of primary ignition to the flashpowder within the flashpan of a flintlock firearm mechanism, in such manner and with comparison to the igniting elements of the earlier matchlock system.

It is a main object of this invention to provide in combination with a flintlock mechanism, through conversion by the invention to the use of phosphorus friction matches within the flintlock mechanism, resulting in a superior method of producing a more intense and reliable primary ignition and effective delivery of the improved ignition to the flashpowder within the cavity of the flashpan and the adjacent prime-hole.

Other and further important objects of this invention will become apparent from the following description and accompanying drawings showing a preferred form of the invention.

DESCRIPTION OF THE INVENTION

Figure 1:
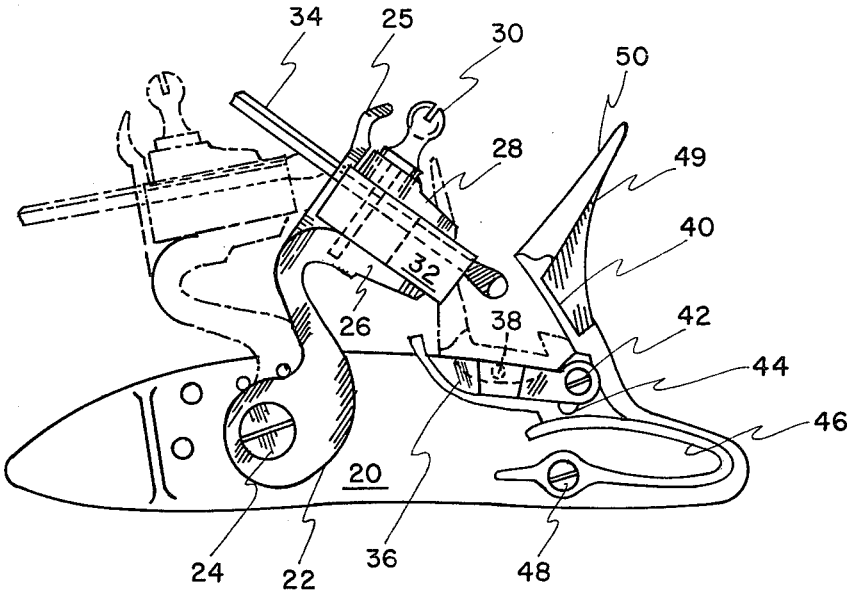
FIG. 1 is a side view of a converted flintlock mechanism, the invention inserted within the jaws of the striker-hammer or cock of said mechanism.

The converted flintlock mechanism of FIG. 1 includes the lock plate or base 20 which is a structurally strong element usually attached to the side of the gunstock. The external face is shown on FIG. 1. On the reverse or backside plate 20 carries spring means and means whereby the cock or striker-hammer 22 is held at half-cock or full-cock and released upon pressure applied to the usual trigger at the underside of the gunstock. These elements are not illustrated as their form and construction may be conventional and are well known to the art.

Figure 3:
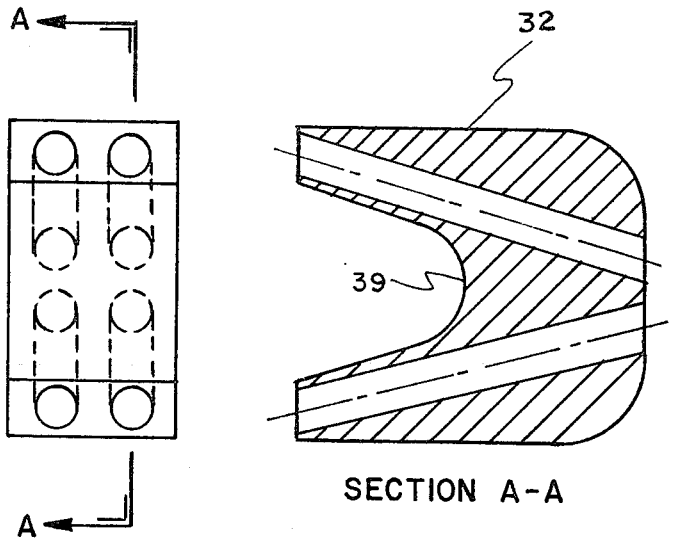
FIG. 3 is a sectional view with related rear face view of plurality of match guide-holes within invention.

The cock or strike-hammer shown as S-shaped or goose-necked pivots on screw 24 supported by plate 20. Cock or striker-hammer 22 includes clamping means comprising the lower fixed jaw 26 and the upper movable jaw 28 tightened by screw 30. The matchlock convertor 32 is firmly held between the upper jaw 28 and the lower jaw 26 when the screw 30 is placed through the screw cut-out 39 and is firmly tightened in place by the action of the screw 30. The relative screw cut-out 39 is shown on FIG. 3.

As shown on base or lock plate 20 in FIG. 1 directly forward of the cock or striker-hammer 22 is the flashpan 36, the pan having an upwardly and open cavity to receive the priming flashpowder. Adjacent to the flashpan 36 is the prime-hole 38 also known as a vent or touch-hole, this hole extending through the plate 20 and into the breech of the barrel.

Flashpan 36 and the priming flashpowder therein is covered by the L-shaped cover 40 which includes the upstanding frizzen or battery 49. Cover 40 pivots on screw 42 mounted on lock plate 20. Feather or leaf spring 46 cooperates with horn 44 extending from cover 40 in both the open and closed positions of the cover 40.

The frizzen or battery 49 has an upturned and curved striking face 50 against which the matchlock convertor 32 holding the inserted and posed phosphorus friction match 34 snaps forward striking the face of the frizzen 50 the resulting friction on the tip or head of the friction match 34 causing an immediate burst of flame and subsequent ignition within the cavity of the flashpan 36.

After the usually finer grade of priming powder as flashpowder is placed into the cavity of the flashpan 36 and adjacent prime-hole 38, the L-shaped cover 40 is swung on pivot screw 42 to a position covering the flashpowder within the pan cavity. In this position of cover 40, the frizzen or battery 49 stands upright and in the path of the phosphorus friction match 34 within the guide-hole of the matchlock convertor 32.

Backward pressure to hammer spur 25 and/or screw 30 cocks the mechanism. Striker-hammer 22 so cocked stands as shown in FIG. 1. The mechanism is fired by pulling a trigger (not shown) releasing the cock or striker-hammer 22 and the matchlock convertor 32 carried therein. The convertor 32 with the match insert 34 snaps rapidly forward under actuating force supplied by a mainspring to striker-hammer 22. The tip or head of the phosphorus friction match 34 then sharply strikes the face 50 of the frizzen 49. Almost simultaneously several events occur and the impact knocks the frizzen backward and away from the flashpan 36 causing the pan cover 40 to rise from the flashpan 36, thus exposing the priming flashpowder. A large amount of flame or ignition is generated as the matchlock convertor 32 with inserted match 34 snaps against the striking face 50 of the frizzen or battery 49. This flame or ignition ignites the priming flashpowder within the cavity of the flashpan 36, the resulting flash burning the priming powder within the prime-hole, touch-hole, or vent 38 and to the main charge of coarse blackpowder in the breech of the gun firing the projectile or bullet.

Figure 2:
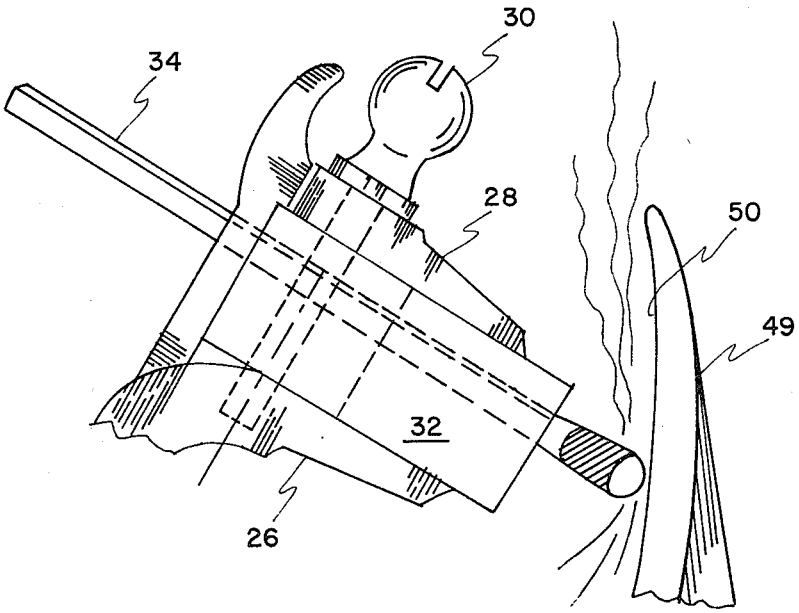
FIG. 2 is an enlarged fragmentary view, illustrating the invention producing ignition with a single phosphorus friction match in in combination with said mechanism.

Thus shown in FIG. 2 is the friction match 34 as within the convertor 32, the extending tip or head of match 34 in direct friction contact with face 50 of frizzen or battery 49. The phosphorus friction match 34 is so held and posed by the matchlock convertor 32 as shown on FIG. 4, through the plurality of match guide-holes as shown on FIG. 3.

Figure 5:
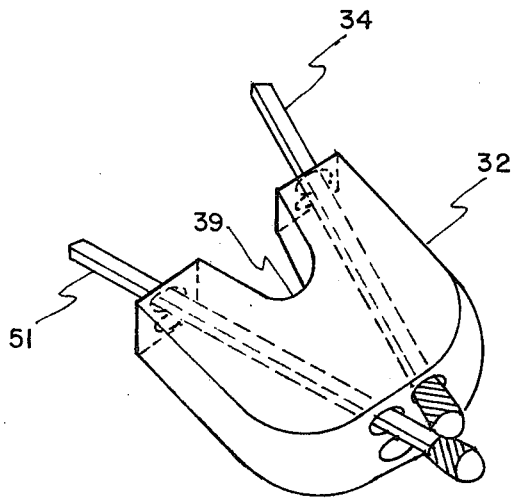
FIG. 5 is a perspective view of two phosphorus friction matches in proper position.

In the double match mode of FIG. 5 there are two friction points of contact as the tip or head of the phosphorus friction match 34 rubs against the tip or head of match 51 when the matchlock convertor 32 with respect to FIG. 1 then carries both matches to the friction surface at the frizzen face 50 whence the initiating friction is obtained.

Figure 6:
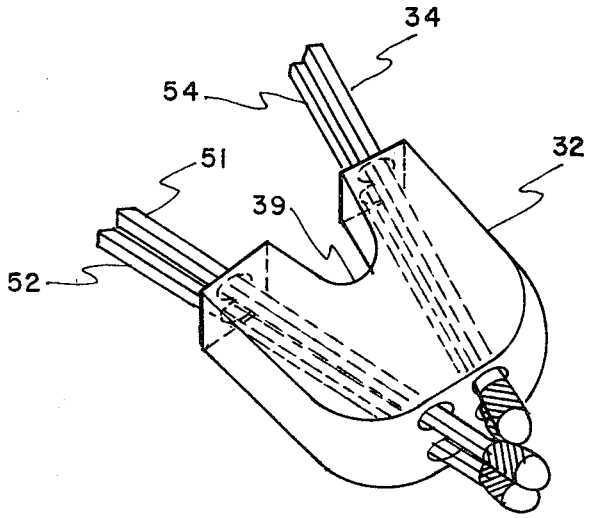
FIG. 6 is a perspective view of four phosphorus friction matches in proper position within invention.

As shown in FIG. 6 the amount of matches used as compared to FIG. 5 has now been doubled as match 34 rubs against match 51 and the like action of match 54 against match 52, the combined four matches striking the face of the frizzen or battery 50 almost simultaneously producing the largest flame or ignition possible within described sequence.

Figure 4:
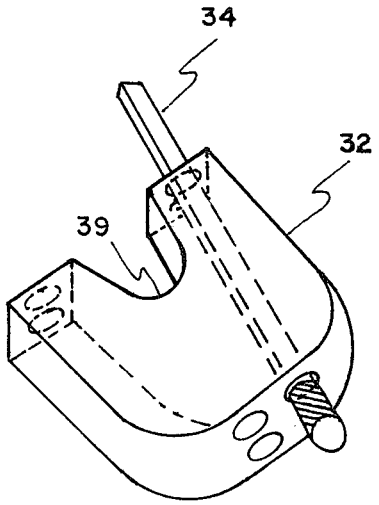
FIG. 4 is a perspective view, single match within guide-hole friction tip or head at frontal face of invention.

It has been found that as the matches used are gradually increased in number within the matchlock convertor 32 as shown in FIG. 4, FIG. 5, FIG. 6 so may the flashpowder used for priming be gradually reduced. When four phosphorus friction matches are inserted as shown on FIG. 6 a small amount of priming only is needed at prime-hole 38 as shown on FIG. 1 to achieve ignition.

The matchlock convertor can have a long life, but with respect to FIG. 1 whenever wear occurs to the top frontal face of the convertor it can simply be overturned and re-inserted within the jaws of the cock or striker-hammer and a newly presented surface is provided.

Construction materials are not limited and any of a number of types could be used as; steel, aluminum, brass, some heat resistant plastics known within the art.

I claim:

1. In a firing mechanism for a flintlock rifle wherein an igniting means is carried within upper and lower jaws of a hammer, said jaws being tightened by a screw, and upon triggered release of the hammer the igniting means snaps forward and strikes an upstanding frizzen disposed above a flashpan thereby igniting flashpowder within said pan, the improvement comprising:

Said igniting means being a matchlock converter which comprises;

Upper and lower surfaces parallel to each other and to the jaws of the hammer;

a cut-out for the screw to pass through;

and angled holes passing through the converter converging toward the end of the converter nearest the frizzen, through which holes pyrophoric friction matches extend with their heads in contact with each other thereby increasing the likelihood of ignition upon firing.

* * * * *